US008998624B2

(12) United States Patent
Ida et al.

(10) Patent No.: US 8,998,624 B2
(45) Date of Patent: Apr. 7, 2015

(54) CONNECTOR

(71) Applicant: Molex Incorporated, Lisle, IL (US)

(72) Inventors: Ayako Ida, Yamato (JP); Akira Sagayama, Yamato (JP); Akinori Mizumura, Yokohama (JP)

(73) Assignee: Molex Incorporated, Lisle, IL (US)

( * ) Notice: Subject to any disclaimer, the term of this patent is extended or adjusted under 35 U.S.C. 154(b) by 136 days.

(21) Appl. No.: 13/898,882

(22) Filed: May 21, 2013

(65) Prior Publication Data

US 2013/0323979 A1 Dec. 5, 2013

(30) Foreign Application Priority Data

May 31, 2012 (JP) ..... 2012-124048

(51) Int. Cl.

| | |
|---|---|
| ***H01R 12/00*** | (2006.01) |
| ***H01R 13/40*** | (2006.01) |
| ***H01R 13/20*** | (2006.01) |
| *H01R 12/77* | (2011.01) |

(52) U.S. Cl.

CPC ..... *H01R 13/40* (2013.01); *H01R 13/20* (2013.01); *H01R 12/774* (2013.01)

(58) Field of Classification Search

USPC ..... 439/74, 67, 77, 494, 497

See application file for complete search history.

(56) References Cited

U.S. PATENT DOCUMENTS

| | | | | |
|---|---|---|---|---|
| 7,674,114 | B2 * | 3/2010 | Tanaka et al. | 439/74 |
| 8,465,328 | B2 * | 6/2013 | Iida et al. | 439/660 |

FOREIGN PATENT DOCUMENTS

| | | |
|---|---|---|
| JP | 2008-270100 | 11/2008 |

* cited by examiner

*Primary Examiner* — Xuong Chung Trans

(74) *Attorney, Agent, or Firm* — Timothy M. Morella

(57) ABSTRACT

Each terminal member of a first connector includes a protruding terminal, and each terminal member of a second connector includes an opening able to accommodate a protruding terminal. The terminal members form a plurality of rows at a fixed interval in the width direction of the main body portion, and each terminal member is staggered in the width direction with respect to the terminal member in the adjacent row. At least the terminal members on the first connector or the second connector are connected to the tip of the plurality of parallel wiring provided in a different layer than the terminal member in the main body portion.

20 Claims, 16 Drawing Sheets

CONNECTOR

REFERENCE TO RELATED APPLICATIONS

The Present Disclosure claims priority to prior-filed Japanese Patent Application No. 2012-124048, entitled "Connectors," filed on 31 May 2012 with the Japanese Patent Office. The content of the aforementioned patent application is incorporated in its entirety herein.

BACKGROUND OF THE PRESENT DISCLOSURE

The Present Disclosure relates, generally, to connectors.

In electronic devices, there is increasing demand for more compact and more integrated connectors to keep pace with the miniaturization and improved performance of these devices and their components. Thus, a connector has been proposed in which a plurality of conductive patterns has been formed on an insulating film, and the end portions of these conductive patterns are connected to another board. An example of such a connector is disclosed in Japanese Patent Application No. 2007-114710, the content of which is incorporated in its entirety herein.

FIG. 17 is a top view showing a conventional connector mated with another connector. In this drawing, 911 is a female-side base serving as the base of a female connector, and this is mounted on the surface of a circuit board which is not shown in the drawing. Also, 811 is a male-side base serving as the base of a male connector, and this is mounted on the surface of another circuit board which is not shown in the drawing. A terminal accommodating opening 954 is formed in the female-side base 911 and passes through to both surfaces of the female-side base 911. A plurality of female-side electrode patterns 951 are arranged in the lateral direction at a predetermined interval inside the terminal receiving opening 954.

Each female-side electrode pattern 951 has a tail portion 958, extending towards the outside of the female-side base 911, and being connected electrically to each conductive trace in an electric circuit formed on the surface of the circuit board. Also, each female-side electrode pattern 951 has an inner opening 954*a* and an arm portion 953 defining the perimeter of the inner opening 954*a*. The inner opening 954*a* has a narrow portion and a wide portion formed near both ends of the narrow portion. In addition, a plurality of protruding terminals 853 is arranged in the traverse direction at a predetermined interval in the male-side base 811; these terminals serve as the male terminals. Each protruding terminal 853 is connected electrically to a conductive trace of the electric circuit formed on the surface of the other circuit board.

In the initial stage of the mating operation, the male connector is moved towards the female connector in the thickness direction of the female connector (perpendicular to the surface of the Figure), and the connectors are mated. At this time, each electrode 853 protruding from the surface of the male-side base 811 is inserted into a wide portion of the inner opening 954*a*. Next, when the male connector is moved relative to the female connector in the vertical direction in the drawing, each protruding electrode 853 moves into the narrow portion of the inner opening 954*a*. This completes the mating of the male connector and the female connector.

Here, each protruding electrode 853 male-side electrode protrusion has a diameter which is greater than the width of the narrow portion of the inner opening 954*a*, but somewhat smaller than the inner diameter of the wide portion. Therefore, in the initial stage of the mating operation for the male connector and the female connector, protruding electrodes 853 are smoothly inserted into the inner opening 954*a* of the female-side electrode pattern 951. When a protruding electrode 853 moves into the narrow portion, the space in the arm portion 953 is pushed apart by the protruding electrode 853, and the protruding electrode 853 is pinched from both sides by the arm portion 953. Therefore, when the mating of the male connector and the female connector is completed, the protruding electrodes 853 and the female-side electrode pattern 951 reliably contact each other and establish an electrical connection.

However, it has been difficult to increase the electrode arrangement density as conventional connectors have become more compact and dense. Because the arm portion 953 of the female-side electrode pattern 951 is widened in the lateral direction by a male-side electrode protrusion, there is a possibility that arm portions 953 of adjacent female-side electrode patterns 951 will come into contact with each other when the pitch or lateral interval between female-side electrode patterns 951 is reduced. Because the positions of the wide portions and narrow portion of the inner openings 954*a* of adjacent female-side electrode patterns 951 are staggered in the vertical direction in a connector of the prior art, the possibility that the contact arm portions 953 will come into contact with each other is reduced. However, because the wide portion of the inner opening 954*a* of each female-side electrode pattern 951 is positioned sideways with respect to the narrow portion of the inner opening 954*a* of the adjacent female-side electrode pattern 951, the interval in the traverse direction is reduced. This makes contact between the arm portions 953 of adjacent female-side electrode patterns 951 more likely.

SUMMARY OF THE PRESENT DISCLOSURE

The purpose of the Present Disclosure is to solve the problem associated with conventional connectors by providing an easy-to-manufacture, low-cost, compact, reliable connector with a simple configuration, in which the terminal members in adjacent rows are staggered in the width direction, and in which adjacent plate-like terminal members are unlikely to come into contact with each other, and the terminal members and the wiring are unlikely to interfere with each other despite the narrow pitch because they are connected to the tips of the wiring provided in different layers.

The Present Disclosure provides connectors having a first connector including a plate-like main body portion and a plurality of plate-like terminal members provided in the main body portion, and a second connector including a plate-like main body portion and a plurality of plate-like terminal members provided in the main body portion mated with the first connector. Each terminal member of the first connector includes a protruding terminal, and each terminal member of the second connector includes an opening able to accommodate a protruding terminal. The terminal members form a plurality of rows at a fixed interval in the width direction of the main body portion, and each terminal member is staggered in the width direction with respect to the terminal member in the adjacent row. At least the terminal members on the first connector or the second connector are connected to the tip of the plurality of parallel wiring provided in a different layer than the terminal member in the main body portion.

In another connector of the Present Disclosure, the wiring extends in the longitudinal direction of the main body portion, and the wiring connected to the terminal members in the front row pass between adjacent terminal members in the rear row when viewed from above. In still another connector, at least one insulating layer is interposed between the layer in which the terminal member connected to the tip of the wiring is arranged and the layer in which the wiring is arranged. In yet another connector, the terminal member connected to the tip of the wiring includes a terminal connecting portion formed to the rear of the protruding terminal or the opening, the wiring includes a wiring connecting portion formed in the tip, and the terminal connecting portion and the wiring connecting portion are connected by a conductive member passing through the insulating layer. In still another connector, there are two rows, and the terminal members in the front row and the terminal members in the rear row are arranged in a staggered pattern in the width direction of the main body portion. Finally, in another connector, the wiring connected to the terminal members in the front row pass between adjacent terminal members in the rear row and overlap with a portion of the terminal members in the rear row.

In the connector of the Present Disclosure, the terminal members in adjacent rows are staggered in the width direction, and are connected to the tips of the wiring provided in different layers. As a result, easy-to-manufacture, low-cost, compact, and reliable connectors with a simple configuration can be provided in which adjacent plate-like terminal members are unlikely to come into contact with each other, and in which the terminal members and the wiring are unlikely to interfere with each other despite the narrow pitch.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
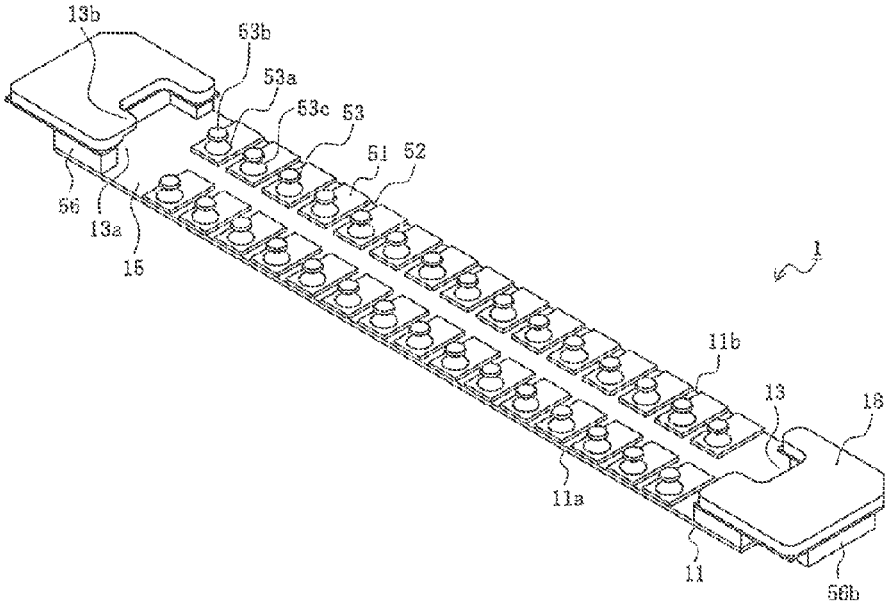
FIG. 1 is a perspective view of a male connector in an embodiment of the Present Disclosure.
Figure 2:
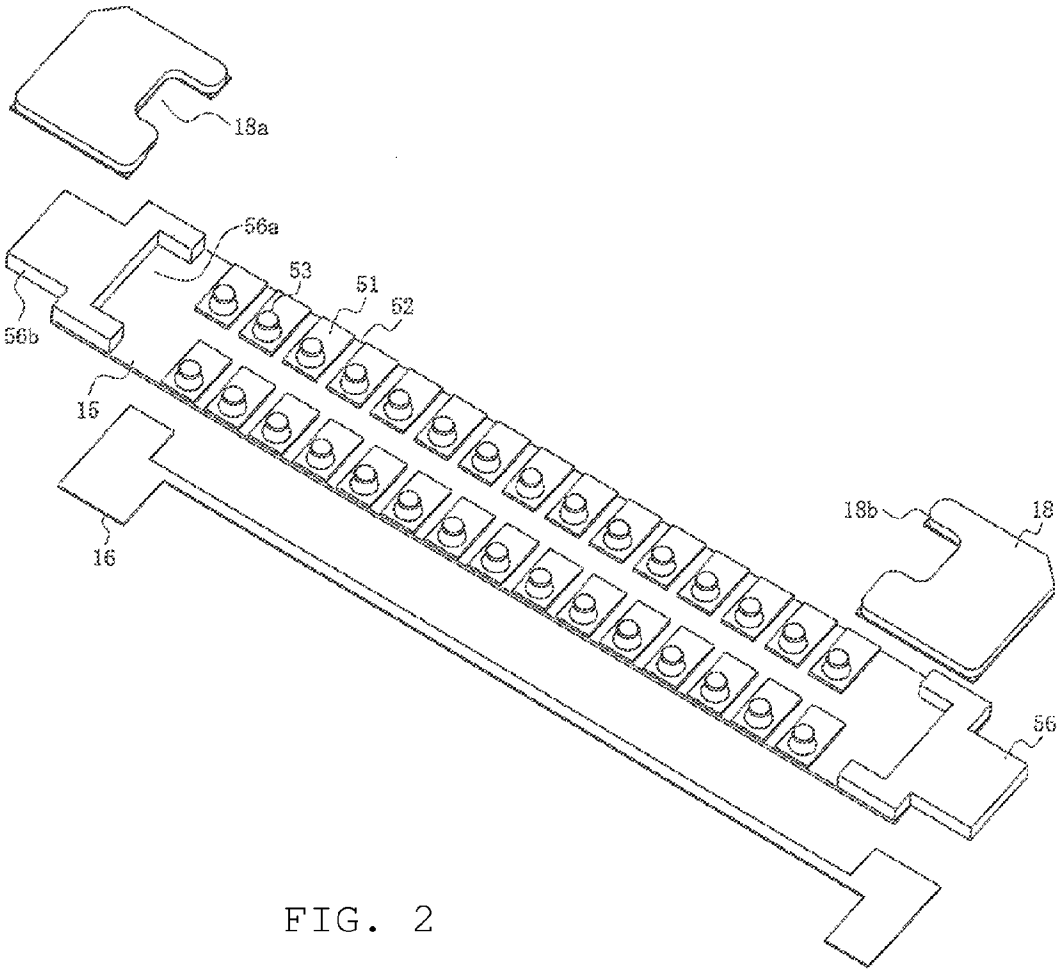
FIG. 2 is an exploded view of the layered structure of the male connector of FIG. 1.
Figure 3:
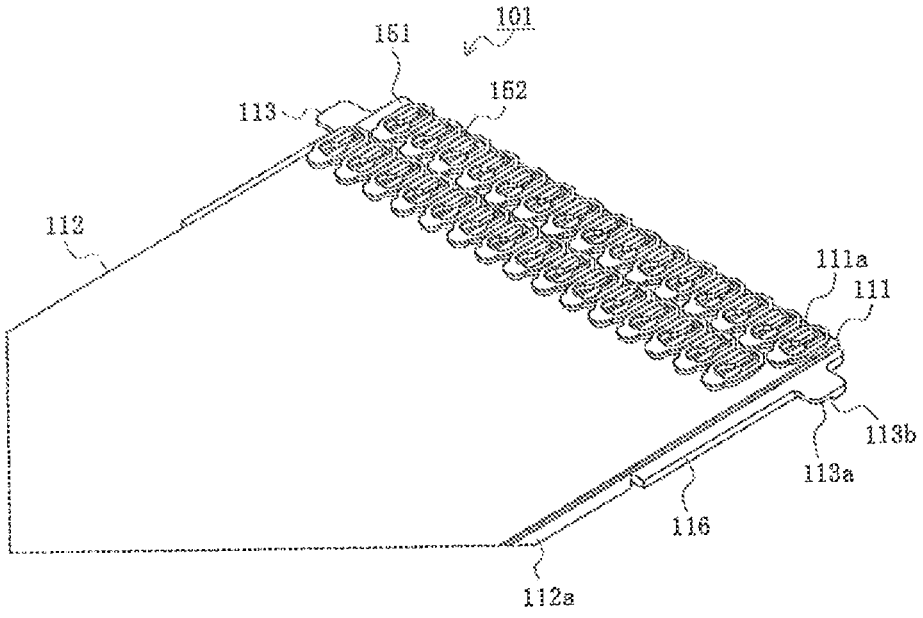
FIG. 3 is a perspective view of a female connector in an embodiment of the Present Disclosure.

Referring to FIGS. 1-2, 1 is the first connector in the connectors of the Present Disclosure and is a male connector. This connector is mounted on a mounting member not shown in the Figures, and is connected electrically to a female connector 101, described below.

The male connector 1 has a plate-like main body portion 11 with a rectangular planar shape. The main body portion 11 includes a reinforcing layer 16, serving as a plate-like reinforcing portion and being a flat, thin plate member from the mounted face side (the lower side in FIGS. 1-2). The main body portion 11 also includes a base film 15 serving as a male board portion, which is a plate-like second board portion or an insulating thin plate portion having a slender, band-like shape. The main body portion 11 also includes a conductive pattern 51 serving as a male conductive portion, which is a plate-like first conductive portion arranged on one face of the base film 15 (the face on the mated face side). A plurality of conductive patterns 51 are separated by pattern separating space 52. The dimension of the main body portion 11 in the thickness direction is from 0.3-0.5 mm, but this dimension can be changed if necessary. The base film 15 can be any insulating material. A reinforcing layer 16 serving as a plate-like reinforcing portion is a flat, thin plate member provided on the other face of the base film 15 (the face on the mounted face side). The reinforcing layer 16 is preferably made of a metal, but can also be made of some other material such as a resin or a composite material.

The conductive patterns 51 are formed, for example, by applying copper foil having a thickness ranging from several to several tens of μm on one face of the base film 15 and then by patterning the copper foil using the etching process. Two separate rows are arranged in parallel along the front end 11*a* and the rear end 11*b* extending in the longitudinal direction of the main body portion 11, and the adjacent conductive patterns 51 in each row are separated from each other and arranged at a predetermined pitch. The row along the front end 11*a* and the row along the rear end 11*b* are arranged to be staggered one-half pitch with respect to the longitudinal direction of the main body portion 11. In other words, the conductive patterns 51 in the row along the front end 11*a* and the conductive patterns 51 in the row along the rear end 11*b* are arranged in a zigzag pattern staggered by one-half pitch with respect to the traverse direction (width direction) of the male connector 1.

Each conductive pattern 51 is a male connector and a female connector functioning as a plurality of conductive wires arranged in parallel. Each is exposed on the mated face of the main body portion 11, and has a single protruding terminal 53 serving as a male terminal and opposing terminal. In the example shown, the conductive patterns 51 and the protruding terminals 53 are arranged in parallel to each other at a predetermined pitch, for example, 0.4 mm, so that two rows extend in the lateral direction of the male connector 1. However, the number, pitch, and arrangement of conductive patterns 51 and protruding terminals 53 are not limited to the example shown in the drawings, and can be changed if necessary.

Each protruding terminal 53 is a member protruding from the surface of a conductive pattern 51, and is integrated with the conductive pattern 51, for example, by performing etching using the photolithographic technique. The dimension of the protruding terminals 53 in the height direction can range, for example, from 0.1-0.3 mm, but this can be changed if necessary. Also, the dimension of the top face and transverse section of the protruding terminals 53 is preferably greater in the longitudinal direction than in the lateral direction. They preferably have a shape which has an inclined portion in the forward direction, for example, a pentagonal or hexagonal shape providing a spherical home base with a point in the forward direction. However, the shape is not limited to the example shown in the drawing.

In the embodiment of the Present Disclosure, the side face shape of the protruding terminals 53 is preferably a recessed face as shown in FIG. 1. More specifically, in the protruding terminals 53, the width dimension of the base portion 53*a*, which is the portion connected to the surface of the conductive pattern 51, is equal to or greater than the tip portion 53*a*, which is the upper end portion. Also, the side portion 53*c* between the base portion 53*a* and the tip portion 53*b* is a smooth face with a smooth shape recessed towards the inside in the lateral direction from both the base portion 53*a* and the tip portion 53*b*. The shape of the side portion 53*c* is preferably a gentle, continuously curved face. However, it can also be a curved surface consisting of a series of interconnected inclined surfaces.

Each conductive pattern 51 is connected electrically to the corresponding mounting pattern (not shown) which corresponds to the other face of the base film 15 (the face on the mounting side). The electrical connection can be established, for example, via a through-hole formed in the base film 15. Each mounting pattern is connected via solder to a connection pad formed on the surface of the board serving as the mounting member. In this way, the male connector 1 can be mounted to the board, and the conductive patterns 51 and protruding terminals 53 can be connected electrically to connection pads on the board. Instead of mounting patterns, tail portions can be formed in each conductive pattern 51 which extend in the traverse direction of the main body portion 11 and protrude outward from the base film 15 so that the tail portions can be connected to the connection pads of the board.

A reinforcing bracket 56 is provided on both sides of the conductive patterns 51. The reinforcing brackets 56 are formed along with the conductive patterns 51 by applying copper foil having a thickness ranging from several to several tens of μm on one face of the base film 15, and then patterning the copper foil using etching so that the brackets extend in the traverse direction of the main body portion 11, and are provided on both ends of the main body portion 11 in the long axis direction separated from the conductive patterns 51. In each reinforcing bracket 56 are formed a recessed portion 56*a* for insertion of a connector engaging ear portion 113 of the female connector 101 as explained below, and a fixing ear portion 56*b* extending to the outside in the longitudinal direction of the main body portion 11. The bottom face of the fixing ear portion 56*b* is exposed on the mounting face of the main body portion 11, and the exposed portion is connected to a fixing pad formed on the surface of the board, for example, via soldering. In this way, the male connector 1 is secured to the board.

An engagement reinforcing plate 18, which is a flat, plate-like engaging portion, is provided on the surface of the reinforcing bracket 56 (that is, on the inserted face). This engagement reinforcing plate 18 is made of metal, but may also be made of a different type of material such as a resin or a composite. Also, an insertion recessed portion 18*a* is formed in each engagement reinforcing plate 18 to insert a connector engaging ear portion 113 on the female connector 101. The engagement reinforcing plate 18 is securely bonded to the reinforcing bracket 56 via a bonding layer 18*b* made of an adhesive. Because the insertion recessed portion 18*a* is arranged at a position corresponding to the recessed portion 56*a*, as shown in FIG. 1, a connector engaging recessed portion 13 is formed to engage the connector engaging ear portion 113 of the female connector 101. Because the dimensions of the insertion recessed portion 18*a* are smaller than the dimensions of the recessed portion 56*a*, an eave-like retaining portion 13*b* and a retaining recessed portion 13*a* covered by the retaining portion 13*b* are formed near the front end 11*a* of the main body portion 11 in the connector engaging recessed portion 13.

Referring to FIGS. 3-6, the female connector 101 is the second connector or the other connector, and has a rectangular planar shape. It is connected electrically to the male connector 1 or the first connector. The female connector 101 may be mounted on a mounting member such as a printed circuit board, a flexible flat cable, or a flexible circuit board. In the present embodiment, it is formed directly on the end portion of a flat cable such as a flexible flat cable or a flexible circuit board, or connected to the end portion via a connecting member. In the example shown, the female connector 101 has a flat cable portion 112, and a flat main body portion 111 formed in or connected to the cable portion 112. The main body portion 111 comprises, in order from the side opposite the inserted side (from the bottom in FIG. 3), a reinforcing layer 116 in the shape of a plate-like member serving as a reinforcing plate portion. The main body portion 111 also comprises a base film 115 serving as an insulating layer or plate-like base portion, which is an insulating thin plate-like member shared with the cable portion 112. The main body portion 111 also comprises conductive wires 161, which are conductive wires arranged in parallel rows on one side (the top side in FIG. 4) of the base film 115. The main body portion 111 also comprises cover film 117, which is an insulating layer serving as a plate-like female covering portion for covering the wires 161. The main body portion 111 also comprises a plurality of plate-like terminals 151 serving as plate-like terminal members or female connectors. A cable reinforcing layer 112*a* can be arranged, if necessary, in the cable portion 112 on the other side (the bottom side in FIG. 4) of the base film 115.

The plate-like terminals 151 have a substantially oval planar shape and are separated by terminal separating spaces 152. Each conductive wire 161 is connected electrically to the corresponding conductive trace in the flat cable. The dimension of the main body portion 111 in the thickness direction is approximately from 0.3-0.5 mm, but this dimension can be changed if necessary. The base film 115 and cover film 117 can be made of any insulating material. The reinforcing layer 116 and cable reinforcing layer 112*a* are preferably made of a metal, but can also be made of some other material.

The conductive wires 161 are formed, for example, by patterning copper foil with a thickness from several to several tens of μm affixed to one side of the base film 115, so as to arrange the wires in parallel at a predetermined pitch. The plate-like terminals 151 are formed, for example, by patterning copper foil with a thickness from several to several tens of μm affixed to one side of the cover film 117, so as to arrange the terminals in a row along the front end 111*a* of the main body portion 111 extending in the traverse direction (width direction) of the female connector 101 and a row formed near the cable portion 112, and so that adjacent plate-like terminals 151 in the same row and adjacent rows are separated from each other and arranged at a predetermined pitch. The pitch is established to be equal to the pitch of the conductive pattern 51 in the male connector 1 and the pitch of the wires 161. The row along the front end 111*a* and the row near the cable portion 112 are arranged so as to be staggered one-half pitch relative to the traverse direction of the female connector 101. In other words, the plate-like terminals 151 in the row along the front end 111*a* and the plate-like terminals 151 in the row near the cable portion 112 are arranged so as to zigzag by one-half pitch relative to the traverse direction of the female connector 101.

Figure 5:
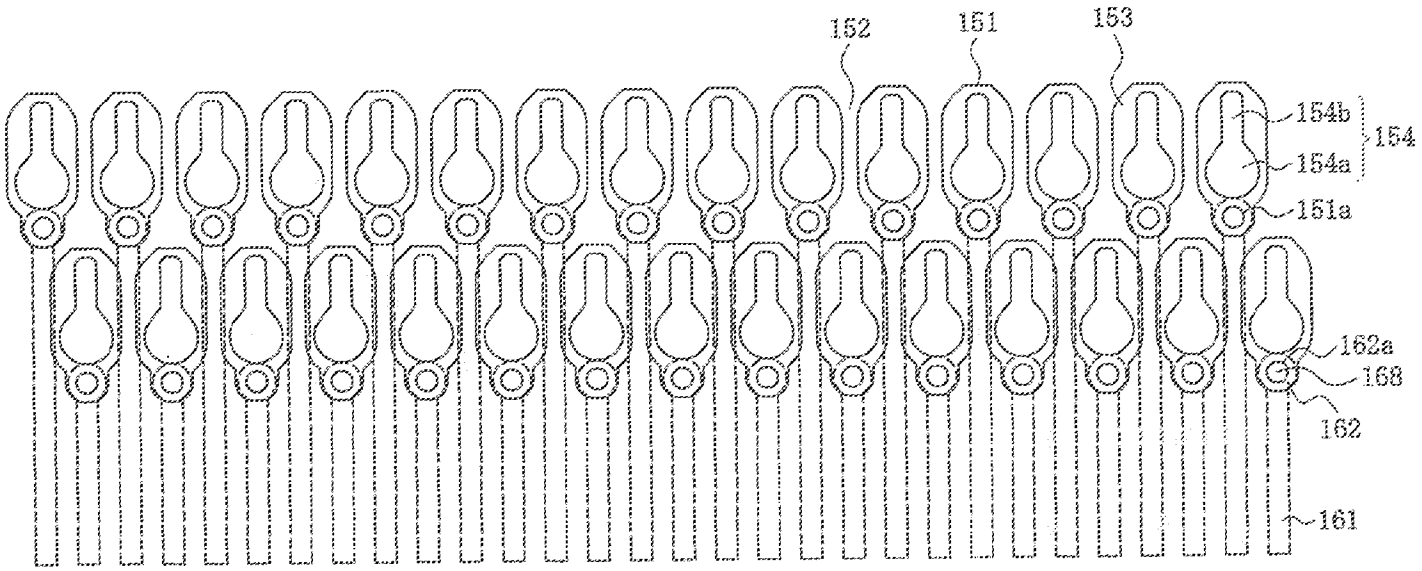
FIG. 5 is a top view of the positional relationship between the female terminals and the wiring in the female connector of FIG. 3.

Each plate-like terminal 151, as shown in FIG. 5, has an opening 154 serving as a protruding terminal accommodating opening with a bottle-shaped planar shape, an arm portion 153 serving as the first terminal member demarcating the left and right sides of the opening 154, and a terminal connecting hole 151*a* serving as a terminal connecting portion. These components have left-right symmetry, that is, a planar shape with linear symmetry. The symmetrical axis of each plate-like terminal 151 is aligned with the central axis of the corresponding wire 161 when viewed from above, and the center of each terminal connecting hole 151*a* is positioned above the central axis of the corresponding wire 161. Each opening 154 passes through the plate-like terminal 151 in the thickness direction. Each opening 154 has a circular or egg-shaped large-diameter portion 154*a* and a small passage-like small-diameter portion 154*b* connected to the front end 111*a* of the main body portion 111 in the large-diameter portion 154*a* and extending towards the front end 111*a*. The opening 154 receives and accommodates a protruding terminal 53 on the male connector 1 when the plate-like terminal 151 is mated with the protruding terminal 53.

The large-diameter portion 154*a* receives the protruding terminal 53 from the tip portion 53*b*, and the dimensions of the inner portion are greater than the outer dimensions of the tip portion 53*b* of the protruding terminal 53. In this way, the protruding terminal 53 can be inserted smoothly into the large-diameter portion 154*a* when the arm portion 153 engages the protruding terminal 53. The small-diameter portion 154*b* allows the protruding terminal 53 inserted into the large-diameter portion 154*a* to be slidably moved. The width dimensions of this portion are equal to or slightly smaller than the diameter or width dimension of the side portions 53*c* of the protruding terminal 53. As a result, when the protruding terminal 53 accommodated inside the large-diameter portion 154*a* is moved into the small-diameter portion 154*b*, both arm portions 153 come into contact with the side portions 53*c* of the protruding terminal 53 and are elastically displaced. In other words, the interval between the arm portions is widened. Because the protruding terminal 53 receives pressure from the arm portions 153, the electrical connection between the protruding terminal 53 and the plate-like terminal 151 remains reliable.

Terminal-aligned openings 117*a* and through-holes 117*b* are formed in the cover film 117 for the opening 154 and terminal connecting hole 151*a* of each plate-like terminal 151. In other words, the terminal-aligned openings 117*a* and the through-holes 117*b*, as in the case of the plate-like terminals 151, are arranged in a zigzag pattern or staggered by one-half pitch in the two rows. The terminal-aligned openings 117*a* and the through-holes 117*b* pass through the cover film 117 in the thickness direction. The terminal-aligned openings 117*a* have an oval-shaped or rounded slot-shaped planar shape. They are larger than the openings 154*a*, but smaller than the outer dimensions of the plate-like terminals 151.

A round connecting end portion 162 is formed in the tip of each wire 161, and a wire connecting hole 162*a* is formed in each connecting end portion 162 as a wire connector. The center of the wire connecting hole 162*a* is positioned along the center line of the wire 161, and the wire 161 passes through in the thickness direction. Also, each wire 161 is arranged so that the wire connecting hole 162*a* is aligned with the terminal connecting hole 151*a* of the corresponding plate-like terminal 151 and a through-hole 117*b* in the cover film 117.

Figure 6B:
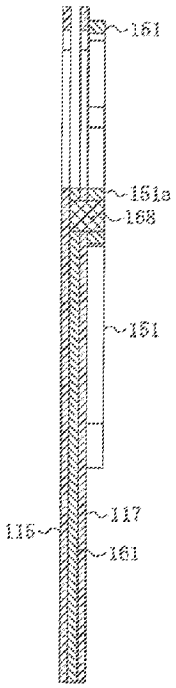
FIG. 6 is a diagram showing the connection relationship between the female terminals and the wiring in the female connector of FIG. 3, in which FIG. 6(*a*) is an enlarged view of the connections from below with the reinforcing layer removed, and FIG. 6(*b*) is a cross-sectional view from Arrow A-A in FIG. 6(*a*)
Figure 6A:
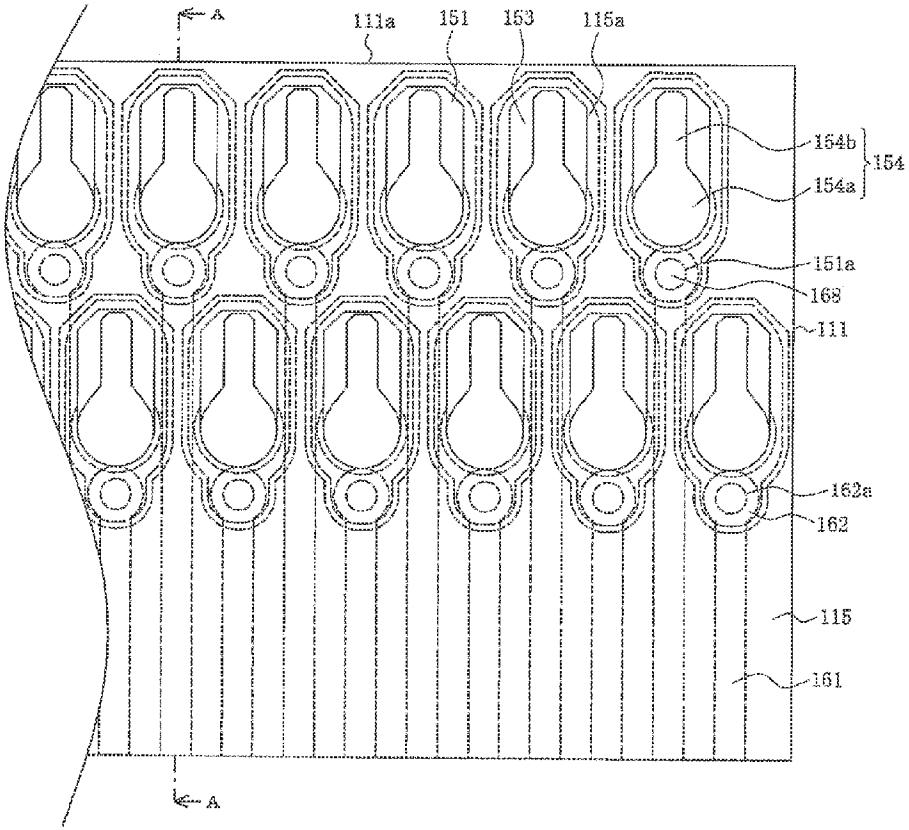

The terminal connecting hole 151*a* for each of the plate-like terminals 151 on the cover film 117 upper side, that is, in the first layer on the mating side, as shown in FIGS. 5-6, establishes an electrical connection with the wire connecting holes 162*a* of the wires 161 on the cover film 117 bottom side; that is, in the third layer on the mating side, via a conductive member 168 passing through the through-holes 117*b*. In other words, the plate-like terminals 151 and the wires 161 are arranged on different layers of the female connector 101, but are connected electrically via a conductive member 168 (made from a highly conductive material).

The connecting end portions 162 and the wire connecting holes 162*a* of the wires 161 are aligned with the plate-like terminals 151, arranged in a zigzag pattern and staggered one-half pitch with respect to each other. Therefore, the wires 161 are arranged so that the connecting end portions 162 at the tip intersects the long wires 161 near the front end 111*a* of the main body portion 111, and the other connecting end portions 162 intersect the short wires 161 far from the front end 111*a* of the main body portion 111. As shown in FIGS. 5-6, the long wires 161 passes between the plate-like terminals 151 adjacent to each other near the cable portion 112 when viewed from above. Because the pitch of the plate-like terminals 151 is narrow, in the example shown, the width of the wires 161 is greater than the distance between adjacent plate-like terminals 151. In other words, when viewed from above, some of the side portion of a plate-like terminal 151, more specifically, some of the arm portion 153, overlaps with the wires 161. However, because the plate-like terminal 151 and the wires 161 are arranged in different levels of the female connector 101, the long wires 161 passing between plate-like terminals 151 in the row near the cable portion 112 is not connected electrically to the plate-like terminals 151.

Terminal-aligned openings 115*a* are formed in the base film 115 which are aligned with the openings 154 in each of the plate-like terminals 151. In other words, the terminal-aligned openings 115*a*, as in the case of the plate-like terminals 151, are arranged in a zigzag pattern and staggered one-half pitch with respect to each other in two rows. The terminal-aligned openings 115*a* pass through the base film 115 in the thickness direction. The terminal-aligned openings 115*a* have an oval-shaped or rounded slot-shaped planar shape. They are larger than the openings 154, but smaller than the outer dimensions of the plate-like terminals 151. Terminal-aligned openings 116*a* are formed in the reinforcing layer 116 which are aligned with the openings 154 in each of the plate-like terminals 151. In other words, the terminal-aligned openings 116*a*, as in the case of the plate-like terminals 151, are arranged in a zigzag pattern and staggered one-half pitch with respect to each other in two rows. The terminal-aligned openings 116*a* pass through the reinforcing layer 116 in the thickness direction. The terminal-aligned openings 116*a* have an oval-shaped or rounded slot-shaped planar shape. They are larger than the openings 154, but smaller than the outer dimensions of the plate-like terminals 151.

Connector engaging ear portions 113 are integrated with the left and right sides of the reinforcing layer 116 and extend outward in the width direction. Each connector engaging ear portion 113 engages a connector engaging recessed portion 13 of the male connector 1 when the female connector 101 is mated with the male connector 1. These ear portions keep the female connector 101 from becoming detached from the male connector 1. A recessed retaining portion 113*b* and an eave-shaped retaining projecting portion 113*a* covering the retaining portion 113*b* are formed in the rear end of each connector engaging ear portion 113 (side of the cable portion 112). When the connector engaging ear portions 113 have engaged the connector engaging recessed portions 13, and the female connector 101 slides towards the front end 11*a* of the male connector 1, the retaining projecting portion 113*a* and the retaining portion 113*b* engage the retaining recessed portion 13*a* and the retaining portion 13*b* of the connector engaging recessed portion 13, and the connector engaging ear portions 113 are kept from becoming detached from the connector engaging recessed portion 13.

Figure 7:
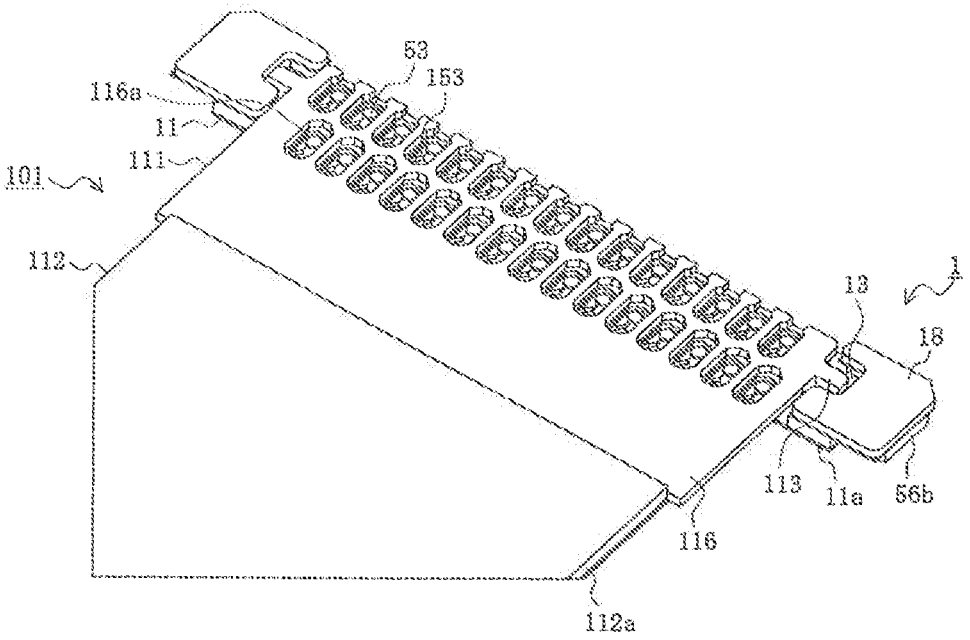
FIG. 7 is a perspective view showing the mated male connector and female connector.
Figure 8B:
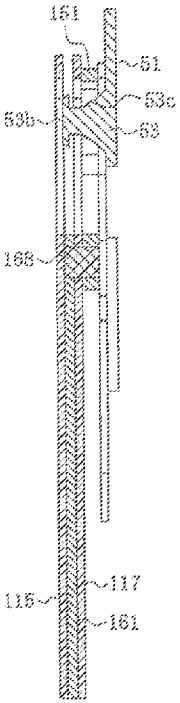
FIG. 8 is a diagram showing the connection relationship between the male terminals of the male connector and the female terminals of the female connector, in which FIG. 8(*a*) is an enlarged top view of the female connector side with the reinforcing layer removed, and FIG. 8(*b*) is a cross-sectional view from Arrow B-B in FIG. 8(*a*)
Figure 8A:
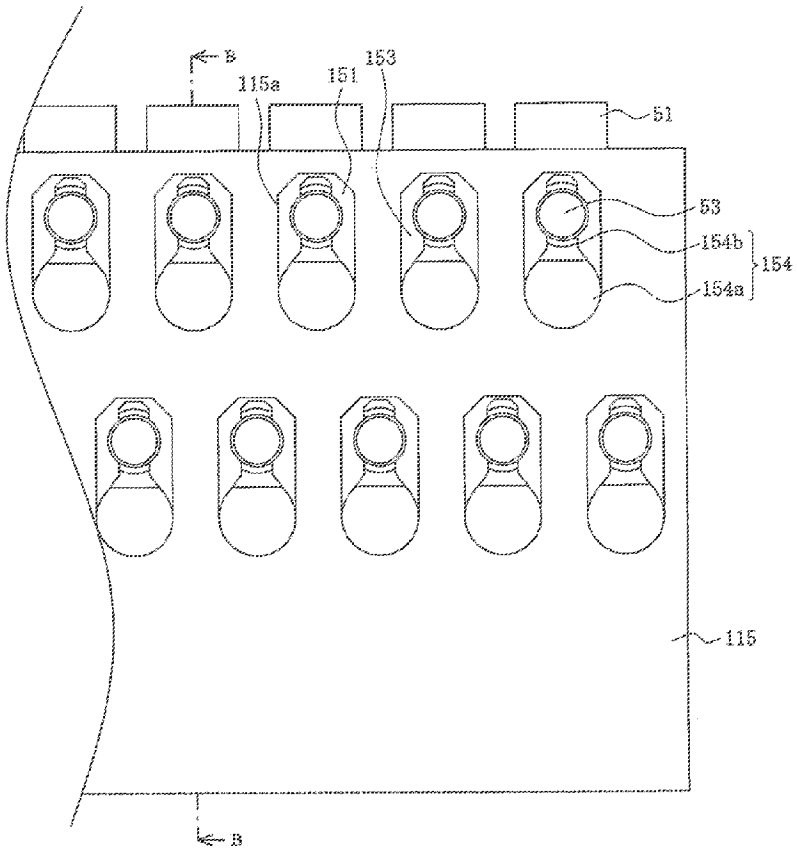

Referring to FIGS. 7-8, to mate a male connector 1 with a female connector 101, the mating face of the male connector 1 (the upper face in FIG. 1) faces the mating face of the female connector 101 (the upper face in FIG. 3), and the female connector 101 is lowered towards the male connector 1. In other words, the connectors are moved in the mating direction and the mating face of the male connector 1 and the mating face of the female connector 101 are brought closer to each other or into contact with each other. In this way, the left and right connector engaging ear portions 113 of the female connector 101 are inserted into the left and right connector engaging recessed portions 13 of the male connector 1, and each protruding terminal 53 of the male connector 1 is inserted into the large-diameter portion 154*a* of the openings 154 in the corresponding plate-like terminals 151 on the female connector 101. Because the inner dimensions of the large-diameter portion 154*a* are greater than the outer dimensions of the tip portions 53*b* of the protruding terminals 53, the protruding terminals 53 can slide smoothly into the large-diameter portions 154*a*.

Next, the female connector 101 is slid into in the male connector 1 towards the front end 11*a* of the male connector 1. In other words, the mating face of the male connector 1 is brought closer to or into contact with the mating face of the female connector 101, and the female connector 101 is moved forward with respect to the male connector 1 towards the front of the male connector 1. Each of the protruding terminals 53 enters the opening 154 in the corresponding plate-like terminal 151, and the left and right connector engaging ear portions 113 enter the left and right connector engaging recessed portions 13 to guide the sliding process. This keeps the female connector 101 from becoming misaligned in the male connector 1.

As shown, when the mating of the male connector 1 and the female connector 101 has been completed, each of the protruding terminals 53 has entered the small-diameter portion 154*b* of the opening 154 in the corresponding plate-like terminal 151. During and after the mating operation performed on the male connector 1 and the female connector 101, the tip portion 53*b* of each protruding terminal 53 does not protrude from the mounting surface of the female connector 101 (the surface opposite the mating surface). In other words, the tip portion 53*b* of each protruding terminal 53 is positioned closer to the mating surface than to the outer face of the reinforcing layer 116.

In the plate-like terminals 151, the interval between the arm portions 153 is pushed apart by the contact with the side portions 53*c* of the protruding terminals 53. The spring action of the arm portions 153 causes the arm portions 153 to apply pressure to the side potions 53*c* of the protruding terminals 53, and the arm portions 153 on both sides elastically pinch the side portions 53*c* of the protruding terminals 53. In this way, the protruding terminals 53 establish reliable electrical contact with the corresponding plate-like terminals 151.

As shown in FIGS. 7-8, when the mating of the male connector 1 and the female connector 101 has been completed, the retaining projecting portions 113*a* of each connector engaging ear portion 113 are accommodated in and retained by the retaining recessed portions 13*a* in the connector engaging recessed portions 13. In this way, the male connector 1 and the female connector 101 are reliably prevented from becoming detached. The operations performed to detach the mated male connector 1 and female connector 101 is the exact opposite of the operations performed to mate the male connector 1 with the female connector 101, so further explanation has been omitted.

In the explanation of the present embodiment, there were two rows of conductive patterns 51 and plate-like terminals 151. Additionally, the conductive patterns 51 in one row and the conductive patterns 51 in an adjacent row may be staggered with respect to the width direction of the main body portion 11, or the plate-like terminals 151 in one row and the plate-like terminals 151 in an adjacent row may be staggered in the width direction of the main body portion 111. Further, in the explanation of the present embodiment, only the plate-like terminals 151 were connected to the wires 161. However, the conductive patterns 51 may also be connected to the wiring. In other words, at least the terminal members in the male connector 1 or the female connector 101 may be connected to the tips of the parallel wiring.

In the present embodiment, the connectors were a male connector 1 having a plate-like main body portion 11 and a plurality of conductive patterns 51 arranged in the main body portion 11, and a female connector 101 mated with the male connector 1 which has a plate-like main body portion 111 and a plurality of plate-like terminals 151 arranged in the main body portion 111. Each conductive pattern 51 in the male connector 1 includes protruding terminals 53, and each plate-like terminal 151 in the female connector 101 includes an opening 154 able to accommodate a protruding terminal 53. The conductive patterns 51 and the plate-like terminals 151 form a plurality of rows and are arranged at a constant pitch in the width direction of the main body portions 11, 111. The conductive patterns 51 in adjacent rows are staggered with respect to the plate-like terminals 151 in the width direction. The conductive patterns 51 or plate-like terminals 151 on at least the male connector 1 or the female connector 101 are connected to the tips of parallel wires 161 arranged in layer of the main body portion 11, 111 other than the one including the conductive patterns 51 or the plate-like terminals 151. In this way, contact between adjacent conductive patterns 51 and plate-like terminals 151 is less likely, even when the pitch of the conductive patterns 51 and the plate-like terminals 151 is narrow. Interference between the conductive patterns 51 or plate-like terminals 151 is also less likely. As a result, more integrated and more reliable connectors are provided. The male connector 1 and female connector 101 are easier to manufacture, the configuration is simpler, and the cost is reduced. The male connector 1 and the female connector 101 also have a lower profile.

Further, the wires 161 extends in the longitudinal direction of the main body portion 111, and the wires 161 connected to the plate-like terminals 151 in the front row pass between adjacent plate-like terminals 151 in the rear row when viewed from above. As a result, the pitch of the plate-like terminals 151 can be reduced. Further, at least one cover film 117 serving as an insulating layer is provided between the layer in which the plate-like terminals 151 connected to the tips of the wires 161 are arranged and the layer in which the wires 161 are arranged. As a result, an electrical connection between plate-like terminals 151 and the wires 161 connected to other plate-like terminals 151 is less likely.

Figure 9:
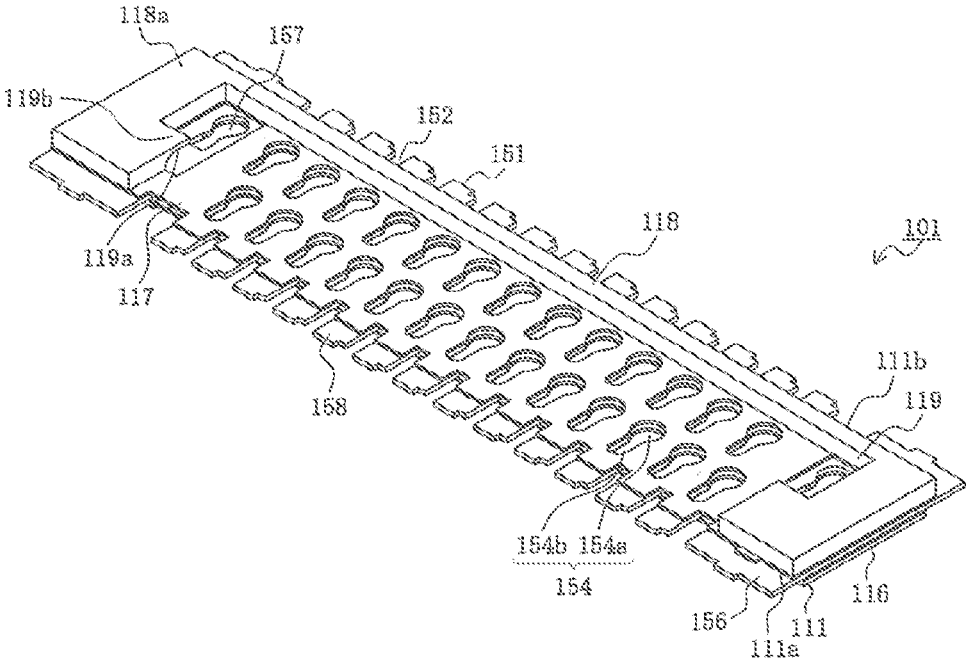
FIG. 9 is a perspective view of a female connector in another embodiment of the Present Disclosure.
Figure 10:
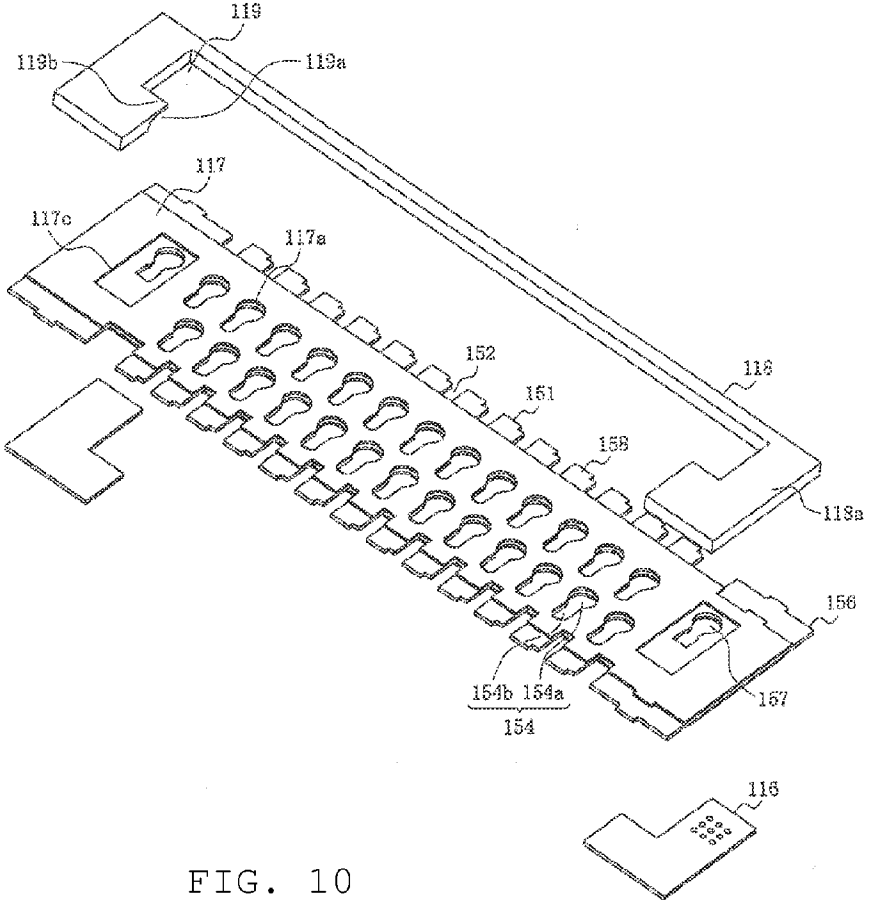
FIG. 10 is an exploded view of the layered structure of the female connector of FIG. 9.

Referring to FIGS. 9-10, which relates to a second embodiment of the Present Disclosure, all configurational elements and components identical to those in the first embodiment are denoted by the same reference numbers, and further explanation of these elements and components has been omitted. Also, further explanation of operations and effects identical to those in the first embodiment has been omitted. In the present embodiment, the female connector 101 is mounted on a mounting member.

In the example shown, the female connector 101 has a plate-like main body portion 111 with a rectangular planar shape. However, unlike the first embodiment, the cable portion 112 is not connected to the main body portion 111. The main body portion 111 has a pair of reinforcing layers 116 with an L-shaped planar shape, a plurality of plate-like terminals 151 with a substantially rectangular planar shape, and a slender band-shaped member. It also has a cover film 117 covering the plate-like terminals 151, and a frame member 118 with a C-shaped planar shape. A pair of reinforcing brackets 156 are provided on the sides of the plate-like terminals 151. The reinforcing brackets 156 are formed along with the plate-like terminals 151, and have a substantially rectangular planar shape. The brackets have a connector engaging hole 157 passing through in the thickness direction, and are provided on both ends in the traverse direction (width direction) of the main body portion 111, separated by the plate-like terminals 151. At least a portion of the bottom surface of the reinforcing brackets 156 is exposed on the surface of the main body portion 111 opposite the mating surface, and this portion is connected to fixing pads formed on the surface of the board using, for example, solder. In this way, the female connector 101 is mounted securely to the board.

As in the case of the first embodiment, the plate-like terminals 151 are formed, for example, by patterning copper foil with a thickness from several to several tens of μm affixed to one side of the cover film 117, to arrange the terminals in a row along the front end 111*a* of the main body portion 111 extending in the traverse direction (width direction) of the female connector 101 and a row formed along the rear end 111*b*, and so that adjacent plate-like terminals 151 in the same row and adjacent rows are separated from each other and arranged at a predetermined pitch. The pitch is established to be equal to the pitch of the conductive pattern 51 in the male connector 1 and the pitch of the wires 161. The row along the front end 111*a* and the row along the rear end 111*b* are arranged to be staggered one-half pitch relative to the traverse direction of the female connector 101. In other words, the plate-like terminals 151 in the row along the front end 111*a* and the plate-like terminals 151 in the row along the rear end 111*b* are arranged to zigzag by one-half pitch relative to the traverse direction of the female connector 101.

Each plate-like terminal 151, as in the first embodiment, has an opening 154 with the same planar shape, and an arm portion 153 serving as the first terminal member demarcating the left and right sides of the opening 154, and a terminal connecting hole 151*a* serving as a terminal connecting portion. These components have left-right symmetry, that is, a planar shape with linear symmetry. Each opening 154 passes through the plate-like terminal 151 in the thickness direction. Each plate-like terminal 151 has a tail portion 158 extending in the traverse direction of the main body portion 111. Each tail portion 158 protrudes outward from the front end 111*a* and the rear end 111*b* of the main body portion 111, and is connected to the connection pads formed on the surface of the board (not shown) using, for example, solder. In this way, the female connector 101 is mounted on the board, and the plate-like terminals 151 are connected electrically to the connection pads on the board.

Terminal-aligned openings 117*a* and side openings 117*c* are formed in the cover film 117 for the opening 154 and terminal connecting hole 151*a* of each plate-like terminal 151. In other words, the terminal-aligned openings 117*a*, as in the case of the plate-like terminals 151, are arranged in a zigzag pattern or staggered by one-half pitch in the rows. The terminal-aligned openings 117*a* and the side openings 117*c* pass through the cover film 117 in the thickness direction. The terminal-aligned openings 117*a* have the same planar size and shape as the openings 154 in the plate-like terminals 151, and the side openings 117*c* have a planar shape substantially larger than the connector engaging holes 157 in the reinforcing brackets 156.

The frame member 118 is preferably made of a metal, but can also be made of some other material such as a resin or a composite material. A connector engaging recessed portion 119 is formed in the end portion 118*a* of the frame member 118, and a connector engaging hole 157 and a side opening 117*c* are positioned inside this connector engaging recessed portion 119. A bottle-shaped retaining portion 119*b* and a retaining recessed portion 119*a* covering the retaining portion 119*b* are formed in the connector engaging recessed portion 119 near the front end 111*a* of the main body portion 111. The other elements of the female connector 101 are similar to those of the first embodiment, so further explanation of these has been omitted.

Figure 4:
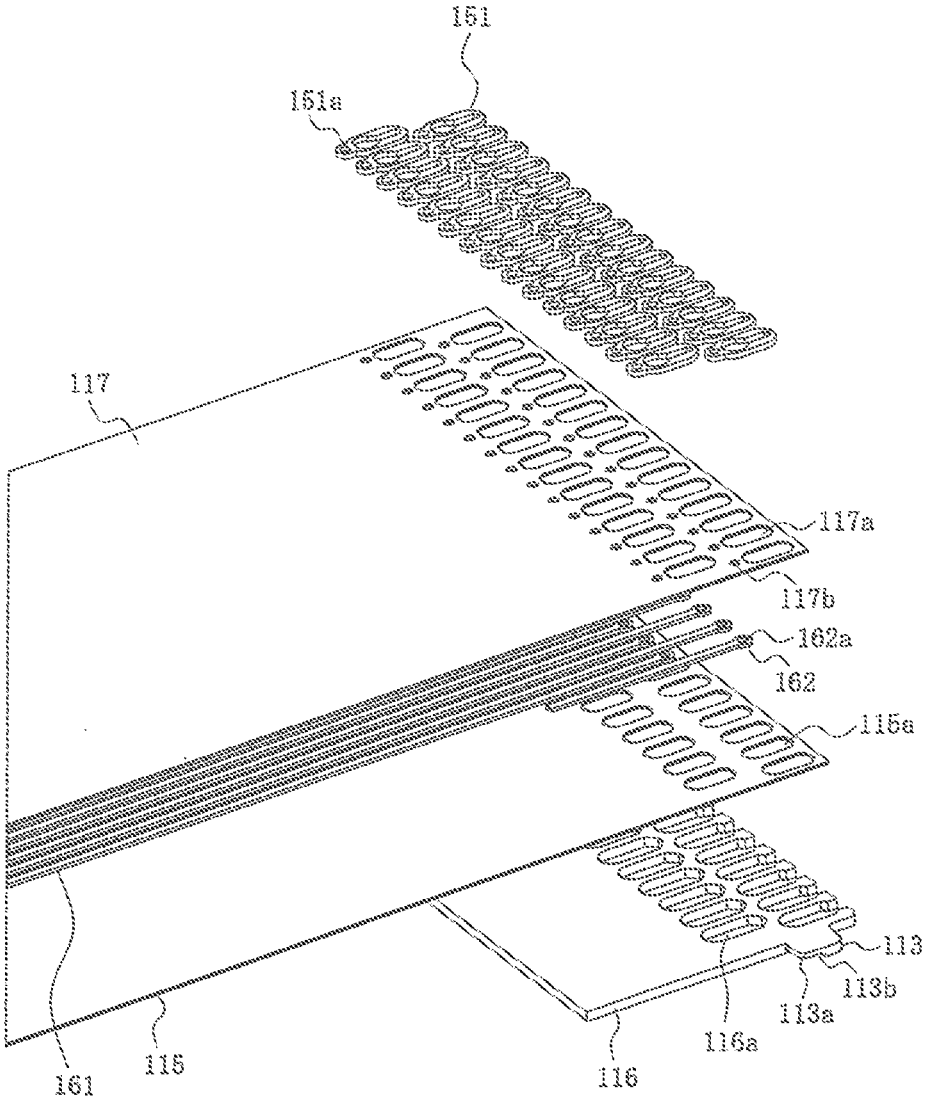
FIG. 4 is an exploded view of the layered structure of the female connector of FIG. 3.
Figure 11:
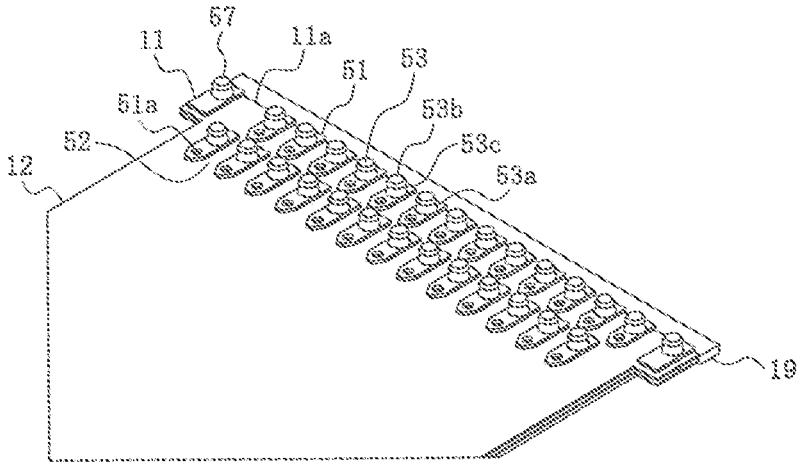
FIG. 11 is a perspective view of a male connector in another embodiment of the Present Disclosure.
Figure 12:
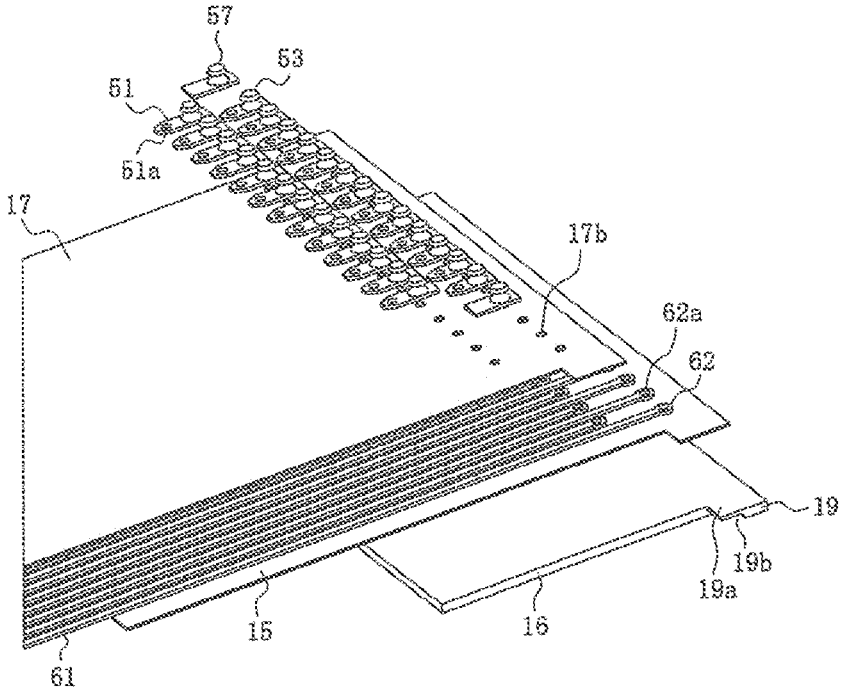
FIG. 12 is an exploded view of the layered structure of the male connector of FIG. 11.

Referring to FIGS. 11-4, the male connector 1 in the present embodiment is formed directly on the end portion of a flat cable such as a flexible flat cable or a flexible circuit board, or connected to the end portion via a connecting member. In the example shown, the male connector 1 has a plate-like cable portion 12, and a plate-like main body portion 11 serving as the connector which is formed or connected to the tip of the cable portion 12. The main body portion 11 comprises, in order from the side opposite the mated side (from the bottom in FIG. 11), the following: a reinforcing layer 16; a base film 15, which is an insulating thin plate-like member shared with the cable portion 12; conductive wiring 61, which is a plurality of conductive wires arranged in parallel rows on one side (the top side in FIG. 12) of the base film 15; cover film 17, which is an insulating layer serving as a plate-like male covering portion or second covering portion for covering the wiring 61; and a plurality of plate-like terminals 51.

Each conductive wire 61 is connected electrically to the corresponding conductive trace in the flat cable. The dimension of the main body portion 11 in the thickness direction is approximately from 0.3-0.5 mm, but this dimension can be changed if necessary. The base film 15 and cover film 17 are made of a resin, but can be made of any other type of material with insulating properties. The conductive wiring 61 is formed, for example, by patterning (for example, etching) copper foil with a thickness from several to several tens of μm affixed to one side of the base film 15, so as to arrange the wires in parallel at a predetermined pitch. The plate-like terminals 51 are also formed, for example, by patterning copper foil with a thickness from several to several tens of μm affixed to one side of the cover film 17, to arrange the terminals in a row along the front end 11*a* of the main body portion 11 extending in the traverse direction (width direction) of the male connector 1 and a row formed near the cable portion 12, and so that adjacent plate-like terminals 51 in the same row and adjacent rows are separated from each other and arranged at a predetermined pitch. The pitch is established to be equal to the pitch of the conductive pattern 151 in the female connector 101 and the pitch of the wiring 61.

The row along the front end 11*a* and the row near the cable portion 12 are arranged so as to be staggered one-half pitch relative to the traverse direction of the male connector 1. In other words, the plate-like terminals 51 in the row along the front end 11*a* and the plate-like terminals 51 in the row near the cable portion 12 are arranged so as to zigzag by one-half pitch relative to the traverse direction of the male connector 1. Each plate-like terminal 51 has one protruding terminal 53 serving as the male terminal and an terminal connecting hole 51*a* serving as a terminal connecting portion. These components have left-right symmetry; that is, a planar shape with linear symmetry. The symmetrical axis of each plate-like terminal 51 is aligned with the central axis of the corresponding wire 61 when viewed from above, and the center of each terminal connecting hole 51*a* is positioned above the central axis of the corresponding wire 61.

Through-holes 17*b* are formed in the cover film 17 corresponding to the terminal connecting holes 51*a* in each conductive pattern 51. In other words, as in the case of the conductive patterns 51, the through-holes 17*b* are arranged in two rows in a zigzag pattern staggered by one-half pitch. The through-holes 17*b* pass through the cover film 17 in the thickness direction.

A round connecting end portion 62 is formed in the tip of each wire 61, and a wire connecting hole 62*a* is formed in each connecting end portion 62 as a wire connector. The center of the wire connecting hole 62*a* is positioned along the center line of the wire 61, and the wire 61 passes through in the thickness direction. Also, each wire 61 is arranged so that the wire connecting hole 62*a* is aligned with the terminal connecting hole 51*a* of the corresponding plate-like terminal 51 and a through-hole 17*b* in the cover film 17. The terminal connecting hole 51*a* for each of the plate-like terminals 51 on the cover film 17 upper side; that is, in the first layer on the mating side, establishes an electrical connection with the wire connecting holes 62*a* of the wires 61 on the cover film 17 bottom side; that is, in the third layer on the mating side, via a conductive member 68 passing through the through-holes 17*b*. In other words, the plate-like terminals 51 and the wires 61 are arranged on different layers of the male connector 1, but are connected electrically via a conductive member 68.

The conductive member 68 is preferably made from a highly conductive material. However, it can be made of any material able to electrically connect to a terminal connecting hole 51*a* and a wire connecting hole 62*a*. For example, it can be a column-shaped metal member forcibly inserted or fitted into a terminal connecting hole 51*a* and a wire connecting hole 62*a* on the upper and lower ends. It can also be a metal member fused with a terminal connecting hole 51*a* and a wire connecting hole 62*a* on the upper and lower ends by filling a terminal connecting hole 51*a*, a through-hole 17*b*, and a wire connecting hole 62*a* with molten metal, and allowing the metal to cool. It can also be solder applied to the inner surface of the through-hole 17*b*, which is then heated and allowed to reflow and establish a connection with a terminal connecting hole 51*a* and a wire connecting hole 62*a* on the upper and lower ends.

Figure 13:
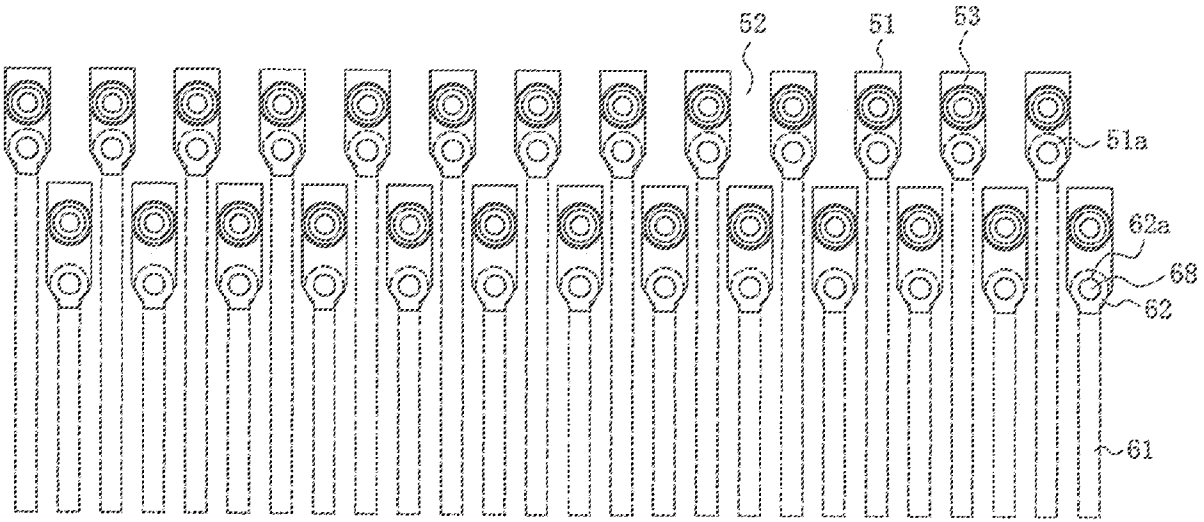
FIG. 13 is a top view showing the positional relationship between the male terminals and the wiring in the male connector.
Figure 14B:
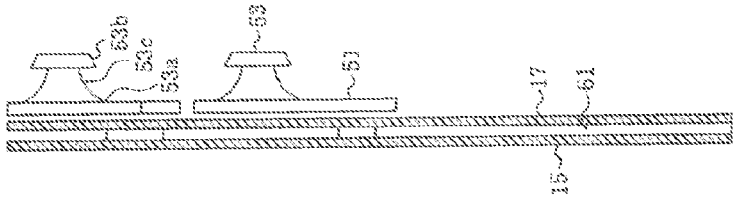
FIG. 14 is a diagram showing the connection relationship between the male terminals and the wiring in the male connector, in which FIG. 14(*a*) is an enlarged view of the connections from below with the reinforcing layer removed, and FIG. 14(*b*) is a cross-sectional view from Arrows C-C in FIG. 14(*a*)
Figure 14A:
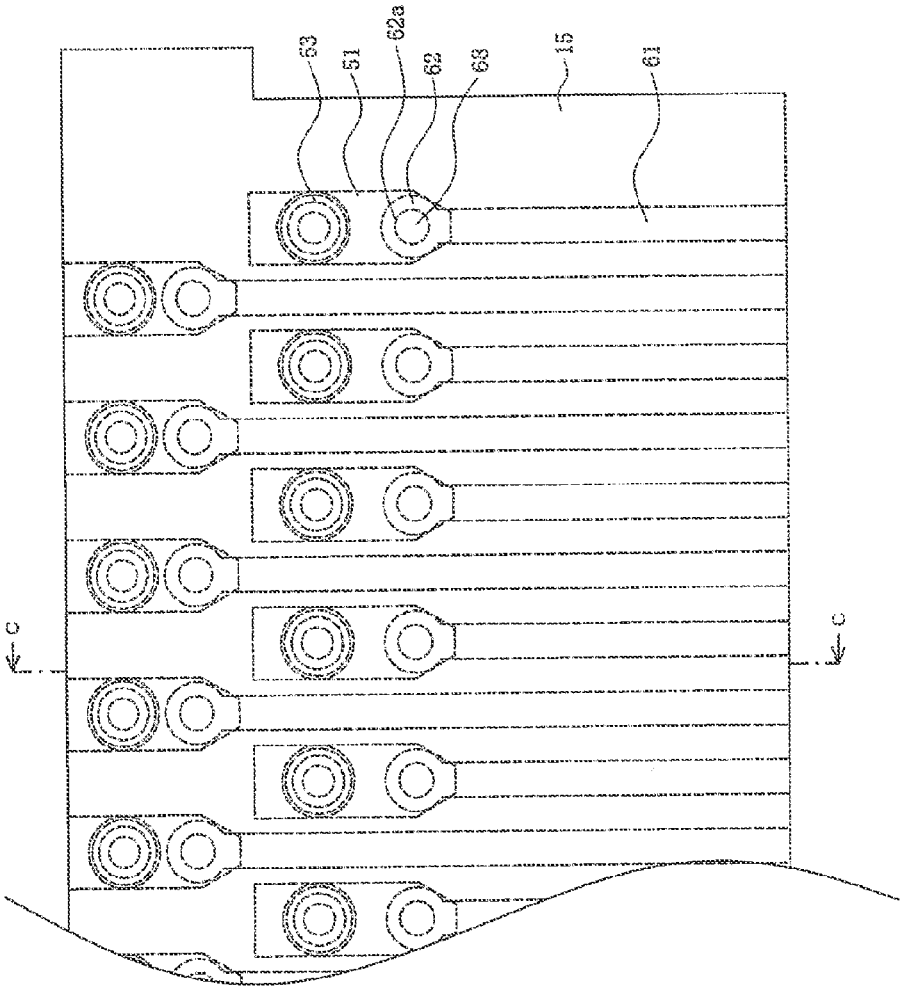

The connecting end portions 62 and the wire connecting holes 62*a* of the wiring 61 are aligned with the plate-like terminals 51, arranged in a zigzag pattern and staggered one-half pitch with respect to each other in the two rows. Therefore, the wiring 61 is arranged so that the connecting end portions 62 at the tip intersects the long wiring 61 near the front end 11*a* of the main body portion 11, and the other connecting end portions 62 intersect the short wiring 61 far from the front end 11*a* of the main body portion 11. As shown in FIGS. 13-4, the long wiring 61 passes between the plate-like terminals 51 adjacent each other near the cable portion 12 when viewed from above. However, because the plate-like terminal 51 and the wiring 61 are arranged in different levels of the male connector 1, the long wiring 61 passing between plate-like terminals 51 in the row near the cable portion 12 is not connected electrically to the plate-like terminals 51.

Connector engaging ear portions 19 are integrated with the left and right sides of the reinforcing layer 16 and extend outward in the width direction. Each connector engaging ear portion 19 engages a connector engaging recessed portion 119 of the female connector 101 when the male connector 1 is mated with the female connector 101. These ear portions keep the male connector 1 from becoming detached from the female connector 101. A recessed retaining portion 19*b* and an eave-shaped retaining projecting portion 19*a* covering the retaining portion 19*b* are formed in the rear end of each connector engaging ear portion 19 (side of the cable portion 12). When the connector engaging ear portions 19 have engaged the connector engaging recessed portions 119, and the male connector 1 slides towards the front end 111*a* of the female connector 101, the retaining projecting portion 19*a* and the retaining portion 19*b* engage the retaining recessed portion 19*a* and the retaining portion 19*b* of the connector engaging recessed portion 119, and the connector engaging ear portions 19 are kept from becoming detached from the connector engaging recessed portion 119.

Connector engaging protruding portions 57 are arranged on one surface of the cover film 17 corresponding to the connector engaging ear portions 19. The connector engaging protruding portions 57 can be formed in the same manner as the protruding terminals 53 in the conductive patterns 51. The connector engaging portions 57 engage the connector engaging holes 157 in the female connector 101 when the male connector 1 is mated with the female connector 101, and position the male connector 1 with respect to the female connector 101.

Figure 15:
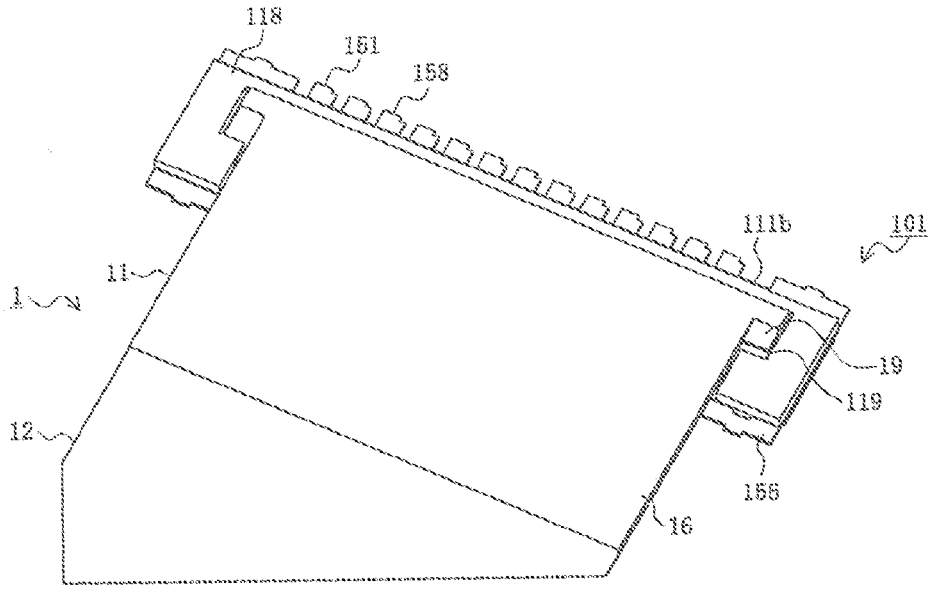
FIG. 15 is a perspective view showing the mated male connector and female connector.
Figure 16B:
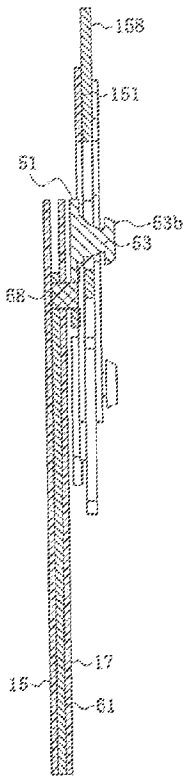
FIG. 16 is a diagram showing the connection relationship between the male terminals of the male connector and the female terminals of the female connector, in which FIG. 16(*a*) is an enlarged top view of the male connector side with the reinforcing layer removed, and FIG. 16(*b*) is a cross-sectional view from Arrows D-D in FIG. 16(*a*)
Figure 16A:
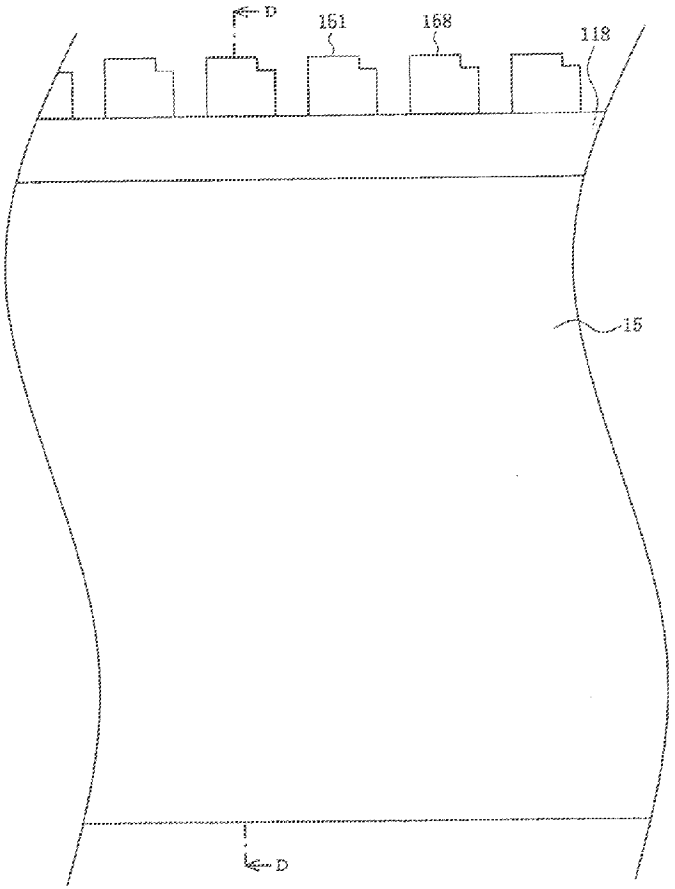
Figure 17:
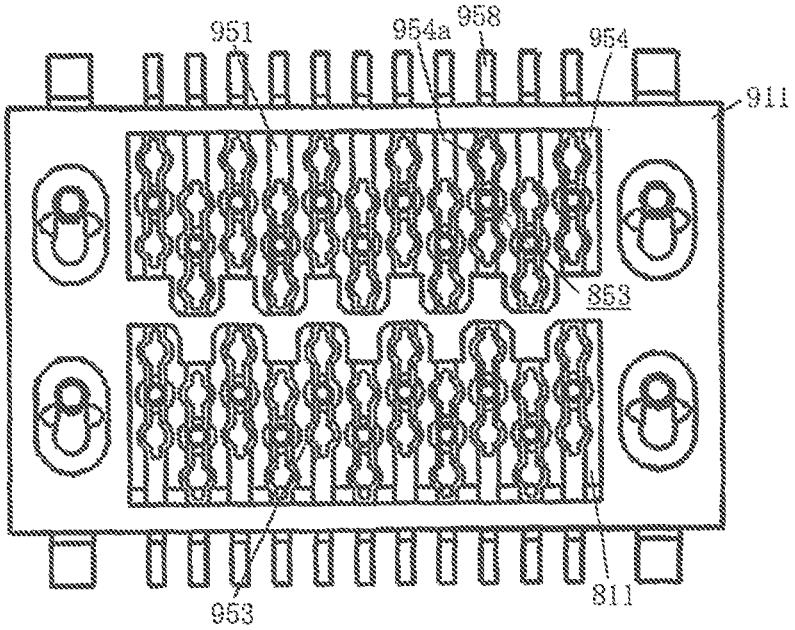
Prior art FIG. 17
FIG. 17 is a top view of an unmated conventional connector.

Referring to FIGS. 15-6, describing the mating of a male connector 1 with a female connector 101 having this configuration, the connectors are arranged so that the mating face of the male connector 1 (the upper face in FIG. 11) faces the mating face of the female connector 101 (the upper face in FIG. 9), and then lowers the male connector 1 towards the female connector 101. In other words, the connectors are moved in the mating direction and the mating face of the male connector 1 and the mating face of the female connector 101 are brought closer to each other or into contact with each other. In this way, the left and right connector engaging ear portions 19 of the male connector 1 are inserted into the left and right connector engaging recessed portions 119 of the female connector 101, and each protruding connector engaging protruding portion 57 of the male connector 1 is inserted into the large-diameter portion 154*a* of the openings 154 in the corresponding plate-like terminals 151 on the female connector 101. Because the inner dimensions of the large-diameter portion 154*a* are greater than the outer dimensions of the tip portions 53*b* of the protruding terminals 53, the protruding terminals 53 can slide smoothly into the large-diameter portions 154*a*.

Next, the male connector 1 is slid into the female connector 101 towards the front end 111*a* of the female connector 101. In other words, the mating face of the male connector 1 is brought closer to or into contact with the mating face of the female connector 101, and the male connector 1 is moved forward with respect to the female connector 101 towards the front of the female connector 101. Each of the protruding terminals 53 enters the opening 154 in the corresponding plate-like terminal 151, and the left and right connector engaging protruding portions 57 enter the left and right connector engaging holes 157 to guide the sliding process. This keeps the male connector 1 from becoming misaligned in the female connector 101.

As shown in FIGS. 15-6, when the mating of the male connector 1 and the female connector 101 has been completed, each of the protruding terminals 53 has entered the small-diameter portion 154*b* of the opening 154 in the corresponding plate-like terminal 151. During and after the mating operation performed on the male connector 1 and the female connector 101, the tip portion 53*b* of each protruding terminal 53 does not protrude from the mounting surface of the female connector 101 (the surface opposite the mating surface). In other words, the tip portion 53*b* of each protruding terminal 53 is positioned closer to the mating surface than to the outer face of the reinforcing layer 116. In the plate-like terminals 151, the interval between the arm portions 153 is pushed apart by the contact with the side portions 53*c* of the protruding terminals 53. The spring action of the arm portions 153 causes the arm portions 153 to apply pressure to the side potions 53*c* of the protruding terminals 53, and the arm portions 153 on both sides elastically pinch the side portions 53*c* of the protruding terminals 53. In this way, the protruding terminals 53 establish reliable electrical contact with the corresponding plate-like terminals 151.

When the mating of the male connector 1 and the female connector 101 has been completed, the retaining projecting portions 19*a* of each connector engaging ear portion 19 are accommodated in and retained by the retaining recessed portions 119*a* in the connector engaging recessed portions 119. In this way, the male connector 1 and the female connector 101 are reliably prevented from becoming detached. The operations performed to detach the mated male connector 1 and female connector 101 is the exact opposite of the operations performed to mate the male connector 1 with the female connector 101, so further explanation has been omitted.

In the present embodiment, there were two rows of conductive patterns 51 and plate-like terminals 151. However, the number of rows is not limited to two. Additionally, the conductive patterns 51 in one row and the conductive patterns 51 in an adjacent row may be staggered with respect to the width direction of the main body portion 11, or the plate-like terminals 151 in one row and the plate-like terminals 151 in an adjacent row may be staggered in the width direction of the main body portion 111. Further, in the present embodiment, only the conductive pattern 51 was connected to the wiring 61. However, the plate-like terminals 151 may also be connected to the wiring. In other words, the terminal members in at least the male connector 1 or the female connector 101 may be connected to the tip of the parallel wiring. Additionally, in the present embodiment, there is no overlap between the conductive pattern 51 and the wiring 61 when viewed from above. However, optionally, there may be overlap between some of the conductive pattern 51 and the wiring 61. Finally, the other points and operations are similar to those of the first embodiment, so further explanation of these has been omitted.

While a preferred embodiment of the Present Disclosure is shown and described, it is envisioned that those skilled in the art may devise various modifications without departing from the spirit and scope of the foregoing Description and the appended Claims.

What is claimed is:

1. A connector assembly, the connector assembly comprising:

a first connector, the first connector including a plate-like main body portion and a plurality of plate-like terminal members provided in the main body portion, each terminal member of the first connector including a protruding terminal;

a second connector mated with the first connector, the second connector including a plate-like main body portion and a plurality of plate-like terminal members provided in the main body portion, each terminal member of the second connector including an opening able to accommodate one of the protruding terminals;

wherein each terminal member:

forms a plurality of rows at a fixed interval in the width direction of the respective main body portion;

is staggered in the width direction with respect to the terminal member in the adjacent row; and in at least one of the first connector and the second connector, is connected to the tip of the plurality of parallel wiring provided in a different layer than the terminal member in the respective main body portion.

2. The connector assembly of claim 1, wherein the wiring extends in the longitudinal direction of the respective main body portion, and the wiring connected to the terminal members in the front row pass between adjacent terminal members in the rear row when viewed from above.

3. The connector assembly of claim 2, wherein the plurality of rows comprises two rows, and the terminal members in the front row and the terminal members in the rear row are arranged in a staggered pattern in the width direction of the main body portion.

4. The connector assembly of claim 3, wherein the wiring connected to the terminal members in the front row pass between adjacent terminal members in the rear row and overlap with a portion of the terminal members in the rear row.

5. The connector assembly of claim 2, wherein at least one insulating layer is interposed between the layer in which the terminal member connected to the tip of the wiring is arranged and the layer in which the wiring is arranged.

6. The connector assembly of claim 5, wherein the terminal member connected to the tip of the wiring includes a terminal connecting portion formed to the rear of the protruding terminal or the opening.

7. The connector assembly of claim 6, wherein the wiring includes a wiring connecting portion formed in the tip.

8. The connector assembly of claim 7, wherein the terminal connecting portion and the wiring connecting portion are connected by a conductive member passing through the insulating layer.

9. The connector assembly of claim 8, wherein the plurality of rows comprises two rows.

10. The connector assembly of claim 9, wherein the terminal members in the front row and the terminal members in the rear row are arranged in a staggered pattern in the width direction of the main body portion.

11. The connector assembly of claim 10, wherein the wiring connected to the terminal members in the front row pass between adjacent terminal members in the rear row and overlap with a portion of the terminal members in the rear row.

12. The connector assembly of claim 1, wherein at least one insulating layer is interposed between the layer in which the terminal member connected to the tip of the wiring is arranged and the layer in which the wiring is arranged.

13. The connector assembly of claim 12, wherein the terminal member connected to the tip of the wiring includes a terminal connecting portion formed to the rear of the protruding terminal or the opening.

14. The connector assembly of claim 13, wherein the wiring includes a wiring connecting portion formed in the tip.

15. The connector assembly of claim 14, wherein the terminal connecting portion and the wiring connecting portion are connected by a conductive member passing through the insulating layer.

16. The connector assembly of claim 5, wherein the plurality of rows comprises two rows.

17. The connector assembly of claim 16, wherein the terminal members in the front row and the terminal members in the rear row are arranged in a staggered pattern in the width direction of the main body portion.

18. The connector assembly of claim 17, wherein the wiring connected to the terminal members in the front row pass between adjacent terminal members in the rear row and overlap with a portion of the terminal members in the rear row.

19. The connector assembly of claim 1, wherein the plurality of rows comprises two rows, and the terminal members in the front row and the terminal members in the rear row are arranged in a staggered pattern in the width direction of the main body portion.

20. The connector assembly of claim 19, wherein the wiring connected to the terminal members in the front row pass between adjacent terminal members in the rear row and overlap with a portion of the terminal members in the rear row.

* * * * *